US005088166A

United States Patent [19]

Lavinio

[11] Patent Number: 5,088,166

[45] Date of Patent: Feb. 18, 1992

[54] SHOE LACING

[76] Inventor: Mick J. Lavinio, 46 Weston Ave., Dalton, Mass. 01226

[21] Appl. No.: 672,427

[22] Filed: Mar. 20, 1991

[51] Int. Cl.[5] ..... A43B 11/00

[52] U.S. Cl. ..... 24/712; 24/713.6; 36/50

[58] Field of Search ..... 24/712, 712.1, 712.9, 24/713.3, 713.6, 715.6, 437, 904; 36/50, 51, 114

[56] References Cited

U.S. PATENT DOCUMENTS

| | | | |
|---|---|---|---|
| 330,152 | 11/1885 | Rammoser | 24/712 |
| 1,409,327 | 3/1922 | Wiltein | 24/712 |
| 1,474,396 | 11/1923 | Zapis | 24/713.6 |
| 1,504,157 | 8/1924 | Sowers | 24/712 |
| 1,862,047 | 6/1932 | Boulet et al. | 24/437 |
| 1,968,012 | 7/1934 | Boghosian | 24/713.6 |
| 4,442,613 | 4/1984 | Dobbin | 36/50 |
| 4,622,763 | 11/1986 | Adams | 36/50 |
| 4,823,426 | 4/1989 | Bragga | 2/DIG. 6 |

FOREIGN PATENT DOCUMENTS

| | | | |
|---|---|---|---|
| 0114088 | 11/1941 | Australia | 24/713.6 |
| 0152941 | 8/1903 | Fed. Rep. of Germany | 24/713.6 |
| 0019857 | of 1895 | United Kingdom | 24/713.6 |

*Primary Examiner*—Victor N. Sakran
*Attorney, Agent, or Firm*—Richard C. Litman

[57] ABSTRACT

A laced shoe includes an upper having a pair of adjacent rows of laterally opposed eyelets. A lace is looped across each opposed pair of eyelets, upon the top of the shoe upper, to form a series of parallel horizontal stretches. A lace is vertically interwoven, in a basket-weave fashion, between the horizontal lace stretches such that a substantially co-extensive mass of horizontal and vertical stretches is formed to provide a lace enclosure offering a fastener of enhanced firmness. Alternatively, two separate laces or a longer single lace may be used to provide the horizontal and vertical stretches, with the distal portions of the single or dual laces being tied together following the formation of the interwoven mass. In the case of two separate laces, the respective ends may alternatively be tied into separate knots at the top and bottom of the lace enclosure. By forming the horizontal and vertical stretches from lace segments of disparate composition or colors, unique personalization is obtainable.

11 Claims, 2 Drawing Sheets

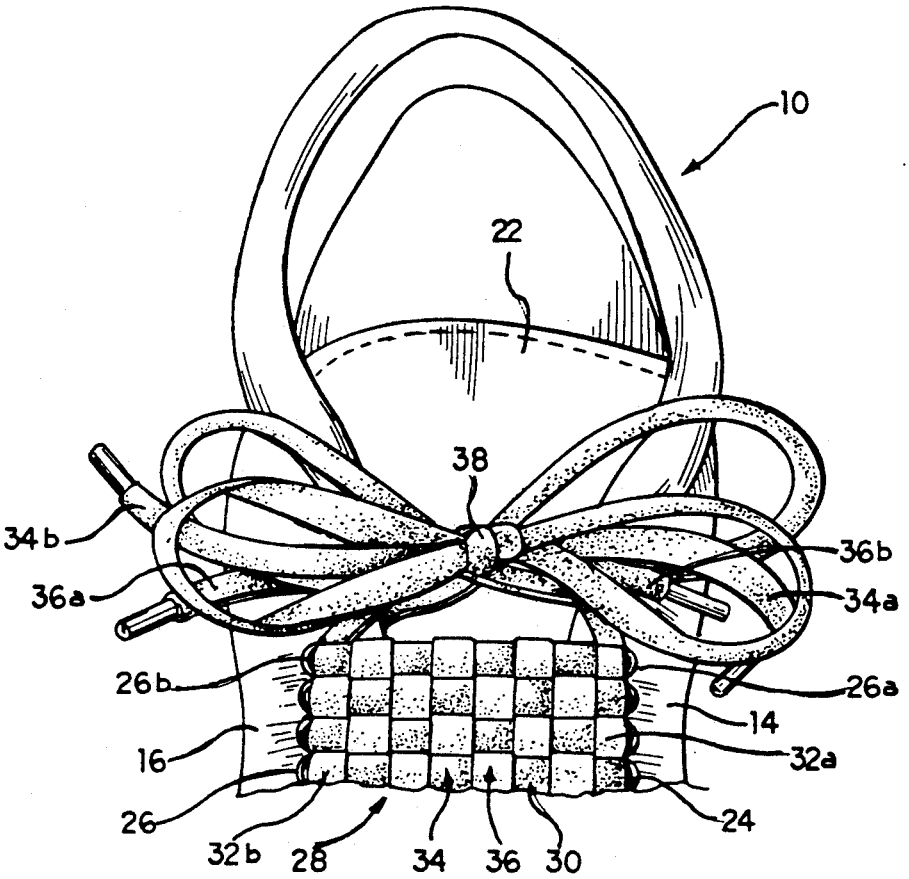
FIG. 3
FIG. 4
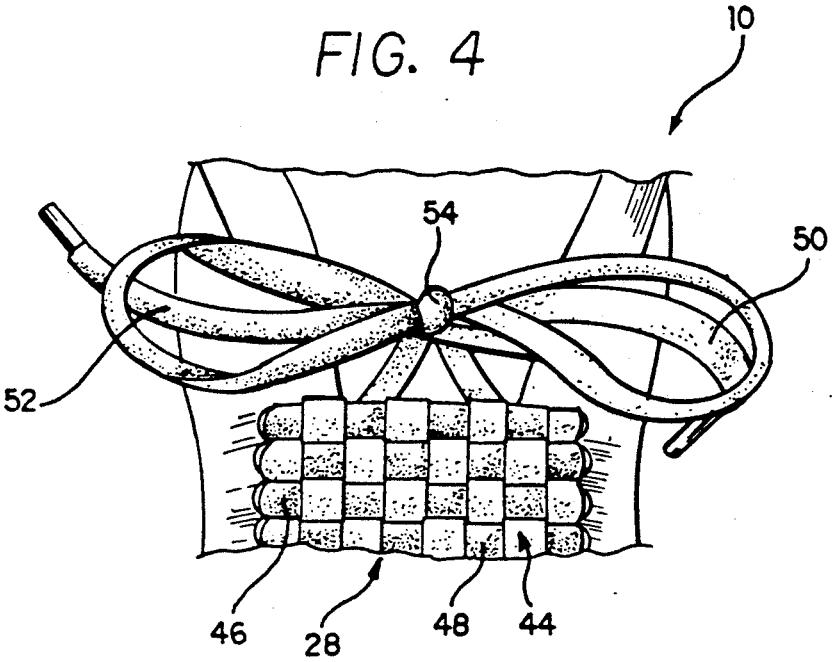

SHOE LACING

FIELD OF THE INVENTION

This invention relates generally to footwear and more particularly, to an improved fastening arrangement comprising uniquely disposed lacing.

BACKGROUND OF THE INVENTION

Shoes intended to be releaseably secured upon a wearer's foot are commonly provided with a lace adapted to cooperate with a plurality of openings or eyelets and which is manipulated in a manner serving to draw the quarters of the shoe upper into close fitting engagement with the foot. Conventionally, the medial portion of a single lace bridges the two lowest most eyelets in the shoe and then, the two free ends are serially and alternately threaded in a zigzag manner, through the eyelets prior to being tied together.

DESCRIPTION OF THE RELATED ART

The concept of enclosing the normally open area atop a shoe tongue is broadly known as in U.S. Pat. No. 1,862,047 issued to Boulet et. al. and which teaches the use of a planar elastic bridging strip as retained by a special disposition of a single lace. U.S. Pat. No. 1,409,327 issued to Wiltein illustrates a shoe lacing arrangement including a combination of horizontal and vertical stretches of securing means but wherein the vertical stretches comprise but one row through each set of aligned eyelets and the horizontal stretches are formed by disparate, metal fasteners. U.S. Pat. No. 4,442,613 issued to Dobbin and U.S. Pat. No. 4,622,763 issued to Adams both suggest the employment of two separate laces for fastening a shoe but in both instances there is no interaction between the respective laces. Instead, one lace is used to secure the lowermost group of eyelets while the second lace engages the remaining, uppermost eyelets. No suggestion is seen in this prior art of the instant construction or shoe fastening method.

SUMMARY OF THE INVENTION

By the present invention, an improved shoe lacing is provided and wherein all or at least substantially all of a shoe tongue is masked by interwoven lacing providing a significantly reinforced fastening. This lacing comprises a combination of horizontal stretches of juxtaposed lacing bridging the aligned and laterally opposed eyelets bounding the shoe tongue and which cooperate with a plurality of vertically extending stretches of lacing woven through the horizontal stretches. In alternate embodiments, all of the lacing may be formed from a single longer length lace or, from two or more separate laces. The latter variant particularly lends itself to employing laces of disparate composition such that varying materials, finishes, patterns and/or colors will be displayed. On the other hand, a single extra length lace having opposite ends of disparate material or patterns may be used. In the foregoing manner, unlimited degrees of personalization may be achieved in numerous types of footwear, either daywear or sportswear. In addition to providing a shoe closure or fastening wherein total enclosure of the space between the upper quarters is achieved, changeable distinctive identification of the wearer is possible. This latter feature finds particular merit for the members of sports teams. An improved shoe lacing method is advanced including the steps of selecting a single lace having a length sufficient to permit threading of the lace through laterally adjacent shoe upper eyelets to provide a series of upper/-most parallel lace stretches. Thence, remaining ends of the same lace are woven through the parallel stretches to form vertical stretches interwoven through the prior stretches and substantially fully enclosing the space between the shoe upper flaps containing the eyelets. Alternatively, a pair of separate laces may be employed to accomplish the above.

Accordingly, one of the objects of the present invention is to provide an improved shoe lacing including parallel stretches of horizontally disposed lacing with vertically disposed stretches of lacing interwoven between the horizontal stretches.

Another object of the present invention is to provide an improved shoe lacing including two separate laces with one lace spanning opposed shoe eyelets to form parallel horizontal stretches and with the other lace forming vertical stretches interwoven between the horizontal stretches.

A further object of the present invention is to provide an improved shoe lacing including one lace attached to eyelets or the like of a shoe and another lace interwoven with the first mentioned lace, with the ends of the two laces joined in either a common knot at either the top or bottom of the lacing, separate adjacent knots or, separate knots at both the top and bottom of the lacing.

Still another object of the present invention is to provide an improved shoe lacing including parallel horizontal stretches of lacing attached to shoe eyelets and comprising a first composition or color and, vertically disposed stretches of lacing interwoven between the horizontal stretches and comprising a second composition or color.

With these and other objects in view which will more readily appear as the nature of the invention is better understood, the invention consists in the novel combination and assembly of parts hereinafter more fully described, illustrated and claimed with reference being made to the attached drawings.

BRIEF DESCRIPTION OF THE DRAWINGS

FIG. 3 is a fragmentary plan view of a completed lacing assembly; and

FIG. 4 is a fragmentary plan view similar to FIG. 3 but illustrating an alternative embodiment utilizing a single lace.

Similar reference characters designate corresponding parts throughout the several figures of the drawings.

DESCRIPTION OF THE PREFERRED EMBODIMENT

Figure 1:
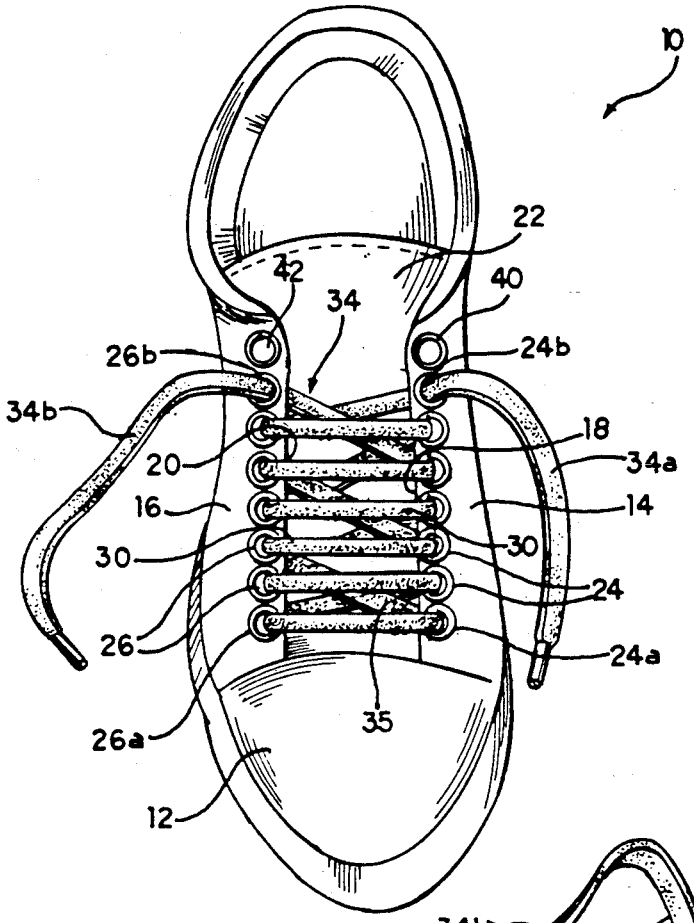
FIG. 1 is a top plan view of a shoe illustrating the instant lacing as it appears following the initial attachment phase.

Referring now to the drawings, particularly FIG. 1, the present invention will be seen to be directed to footwear, such as the illustrated sports shoe 10. Although this type of a shoe is depicted in the drawings, it will be understood that the instant concept may be utilized with any form of footwear such as boots, low quarter dress shoes or the like and which is intended to be fastened upon the wearer's foot by means of lacing as threaded through adjacent rows of eyelets. The illustrated shoe includes an upper 12 from which extend left and right quarters 14,16 respectively provided with inner edges 18,20 overlying a tongue 22.

Conventionally, the shoe would be fastened by threading a single lace, alternately through eyelets 24,26 provided in each quarter 14,16 adjacent its edge 18,20, whereafter the free ends of the lace are drawn together and tied. Regardless of whether the course of the lace between the two quarters is horizontal or diagonal, a considerable area remains exposed between vertically adjacent stretches of the lace, between the lowestmost pair of eyelets **24*a*, 26*a* and the uppermost pair 24*b*, 26*b***. Thus, the degree of firmness of a typically fastened shoe will be somewhat limited by the width and composition of the lacing, considered in combination with the closeness of the eyelets. Particularly in the case of many sports and leisure shoes which are frequently constructed with uppers of very supple and often thin leather or manmade materials, the degree of protection or firmness of support across the top of the foot leaves something to be desired. There is a limitation as to how close together the eyelets on each quarter may be placed. Quite obviously, in the case of uppers made of thin or relatively fragile material, the eyelets may be located only so close, else the constant strain as placed upon the eyelets by the tightened lacing can lead to early rupture of the upper material.

It is by the present invention that existing shoes may be fastened by a lace assembly to provide a co-extensive enclosure of lacing overlying the shoe tongue, between the laterally spaced rows of eyelets on the two quarters. This lacing enclosure, generally designated 28 as depicted in FIGS. 2–4, comprises a lattice as formed by a plurality of parallel, horizontal lace stretches 30 spanning each pair of laterally adjacent eyelets 24,26 and a plurality of parallel, vertical lace stretches 32 as interwoven between the previously arranged horizontal stretches 30.

Frequently, the eyelets of some shoes are spaced from one another too great a distance to achieve the desired end result of closely woven horizontal and vertical stretches. Thus, it will be understood that a wearer may optionally provide additional eyelets in existing shoes such as by punching the uppers to apply further eyelets intermediate the original eyelets.

Initially, the user applies a first lace 34 which is threaded through the eyelets 24,26 in the manner as shown most clearly in FIG. 1 of the drawings. Unlike the most conventional lacing structure wherein a lace is threaded through the eyelets to provide a criss-cross or zig-zag pattern of crossing diagonal lace stretches between two eyelets which are not horizontally opposed, the lace 34 will be seen to be threaded to provide a plurality of the horizontal stretches 30. These stretches 30 are parallel one another, overlie the quarter inner edges 18,20 and extend from the lowermost eyelets **24*a*,26*a* to or adjacent the uppermost eyelets 24*b*,26*b* and terminate in a pair of first lace free ends 34*a*,34*b*. All diagonal reaches 35 of the lace 34 will be understood to be disposed beneath the quarter inner edges 18,20 such that the thickness of these edges is intermediate the horizontal stretches 30 and the diagonal reaches 35. Alternatively, the diagonal reaches 35 may be omitted by threading the lace 34 between vertically alternate ones of the eyelets along each quarter 14,16 after each horizontal stretch 30** is formed.

Figure 2:
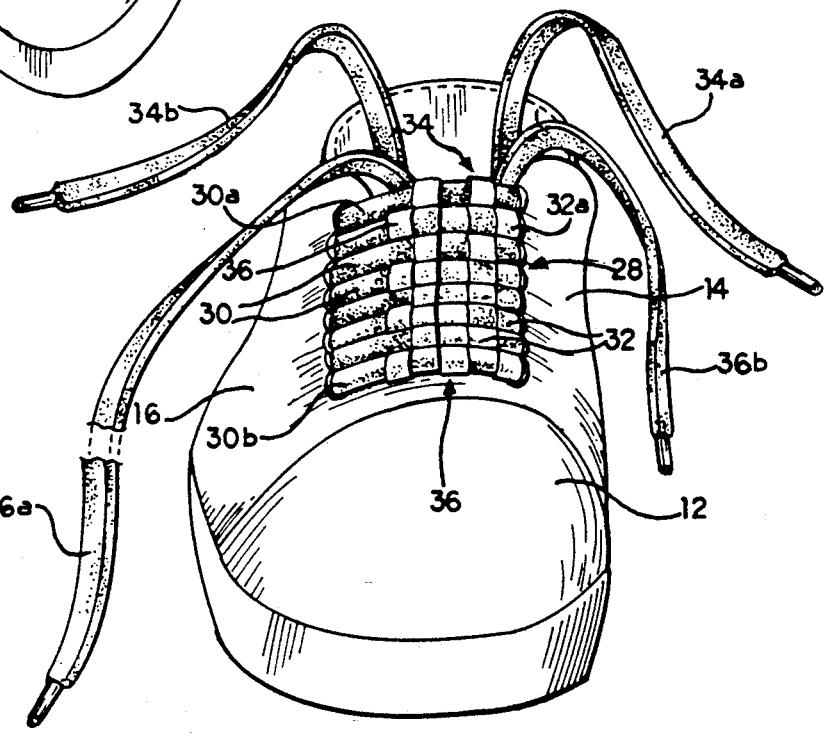
FIG. 2 is a front elevation showing the lacing with the second phase partially completed.

In one embodiment of the invention, a second lace 36 is then assembled with the already installed first lace 34, in the manner as illustrated in FIG. 2. This latter assembly involves inserting one free end **36*a* of the second lace 36, alternately above and below adjacent ones of the horizontal stretches 30, beginning at the topmost stretch 30*a* and continuing to the bottom horizontal stretch 30*b* to form a first vertical stretch 32*a*. Thence, this same second lace is wrapped about the bottom horizontal stretch 30*b* and returned to the topmost stretch 30*a* in the same manner. The weaving procedure is continued in the same manner and when completed, the first free end 36*a* will extend from the last vertical stretch 32*b* (FIG. 3) while the opposite second free end 36*b* remains extended from the other side of the top of the lacing assembly. As will be most apparent the completed assembly of from FIG. 3, both the first and last vertical stretches 32*a*,32*b* are disposed atop the respective eyelets 24,26 so that the resultant lacing enclosure 28 provides a coextensive, closed mass occluding all of the shoe tongue 22 and the eyelets 24,26 therebeneath. With this construction, the second lace 36 will be seen to be woven below and above alternate horizontal stretches 30 to form the basketweave type lacing enclosure 28**.

With the above operation completed as shown in FIG. 3 and wherein the second lace 36 is fully woven across the lateral extent of the distance beneath the horizontal stretches 30 of the upper quarters, it will be noted that the adjacent vertical stretches 32 are crowded together such that the enclosure 28 exhibits a total coextensive body.

Following the above manipulation, the four ends **34*a*,34*b* and 36*a*,36*b* of the two laces 34,36 are suitable joined together as in the illustrated knot 38. In this respect, either or both of the pairs of free lace ends may be threaded through the same topmost eyelets 24*b*,26*b* as used by the first lace 34 or alternatively, passed through a pair of previously unused adjacent eyelets 40,42 (FIG. 1**).

As an alternative to the formation of either one combined knot 38 as in FIG. 3 or two adjacent knots at the top of the assembly, it will be understood that the two laces may be separately tied to provide one knot at the top and one knot at the bottom.

An alternative embodiment is shown in FIG. 4 wherein the same ultimate lacing enclosure 28 is achieved but with the use of a single, longer lace 44. With this construction, the horizontal stretches 46 are accomplished as above described and then, the leading end of the same lace 44 is used to provide the interwoven vertical stretches 48. Thereafter, the two resultant free ends 50,52 are tied into a knot 54.

From the above, it will be appreciated that an improved shoe lacing assembly is presented wherein either two or a single longer lace is installed upon footwear having two rows of laterally spaced eyelets to provide an occluding lacing enclosure overlying the shoe tongue and spanning between the eyelet rows. By utilizing disparate laces or, a longer lace having distinct halves, an identifying pattern may be achieved. In either case, a positive more supportive fastening of the shoe is accomplished.

It is to be understood that the present invention is not limited to the sole embodiment described above, but encompasses any and all embodiments within the scope of the following claims.

I claim:

1. A fastening assembly for a shoe having left and right quarters each provided with a row of eyelets adjacent an inner edge comprising;

a first lacing segment threaded through said eyelets to provide a plurality of horizontal stretches spanning laterally opposed ones of said eyelets of said left and right quarters, a second lacing segment woven through said horizontal stretches and between said eyelet rows of said left and right quarters to provide a plurality of vertical stretches each alternately passing over and under adjacent ones of said horizontal stretches, and at least one said lacing segment having free ends secured to one another.

2. A fastening assembly according to claim 1 wherein, said first and second lacing segments comprise separate first and second laces.

3. A fastening assembly according to claim 2 wherein, said first and second laces are of disparate construction.

4. A fastening assembly according to claim 1 wherein, said horizontal stretches overlie said left and right quarter inner edges, and adjacent ones of said vertical stretches substantially laterally abut each other.

5. A fastening assembly according to claim 4 wherein, two of said vertical stretches respectively substantially overlie said rows of eyelets on said left and right quarters.

6. A fastening assembly according to claim 4 wherein, said vertical and horizontal stretches abut one another to provide a substantially co-extensive enclosure occluding an area between said row of eyelets on said left and right quarters.

7. A fastening assembly according to claim 1 wherein, said first and second lacing segments comprise opposite ends of a single lace.

8. A fastening assembly according to claim 1 wherein, said first and second lacing segments define a basket-weave configuration.

9. A method of providing a fastening assembly for a shoe having left and right quarters each provided with a row of eyelets adjacent an inner edge comprising;

selecting a first lacing segment having two ends and threading one of two ends thereof through laterally opposed ones of said eyelets in said left and right quarters to provide a plurality of horizontal stretches, selecting a second lacing segment having two ends and threading an end thereof serially over and under adjacent ones of said horizontal stretches to provide a plurality of adjacent vertical stretches, urging said plurality of adjacent vertical stretches into lateral abutment, insuring said vertical stretches laterally extend to substantially encompass the spacing between said rows of eyelets, and securing said lacing segment ends together.

10. A method according to claim 9 wherein, said securing of said lacing segment ends includes tying two knots adjacent one another.

11. A method according to claim 9 wherein, said securing of said lacing segment ends includes tying two knots remote from one another.

* * * * *